United States Patent [19]

Toda et al.

[11] Patent Number: 4,546,722

[45] Date of Patent: Oct. 15, 1985

[54] DEVELOPING APPARATUS FOR ELECTROPHOTOGRAPHIC COPYING MACHINES

[75] Inventors: Akitoshi Toda; Yoshiyuki Mimura, both of Hachioji, Japan

[73] Assignee: Olympus Optical Co., Ltd., Tokyo, Japan

[21] Appl. No.: 677,844

[22] Filed: Dec. 3, 1984

[30] Foreign Application Priority Data

Dec. 1, 1983 [JP] Japan ..... 58-228059
Dec. 1, 1983 [JP] Japan ..... 58-228060

[51] Int. Cl.[4] ..... G03G 15/09

[52] U.S. Cl. ..... 118/657; 427/57

[58] Field of Search ..... 427/57; 118/657

*Primary Examiner*—Bernard D. Pianalto
*Attorney, Agent, or Firm*—Louis Weinstein

[57] ABSTRACT

A developing apparatus for an electrophotographic copying machine includes a developer carrier disposed in opposing relationship with a member on which an electrostatic latent image is formed. A vibrator comprising a single sheet piezoelectric element which is adapted to undergo vibrational oscillation in the direction of its thickness or a plurality of such elements bonded together is closely engaged with the developer carrier to cause the developer to fly toward the latent image carrying member.

20 Claims, 11 Drawing Figures

DEVELOPING APPARATUS FOR ELECTROPHOTOGRAPHIC COPYING MACHINES

BACKGROUND OF THE INVENTION

The invention relates to a developing apparatus for use in an electrophotographic copying machine, and more particularly, to such apparatus which converts an electrostatic latent image which is formed as a result of imagewise exposure into a visual image by electrostatically depositing one component developer on the latent image through a non-contact developing process.

A number of developing techniques are available for electrophotographic copying machines, and include a cascade technique, magnetic brush technique, powder cloud technique, jumping technique, impression technique and else, to cite a few typical examples for dry type developing techniques. The developers used may comprise a one component system and a two component system. The cascade and the magnetic brush technique are used with a two component system while the powder cloud technique, the jumping technique and the impression technique are used with a one component system.

To summarize the variety of developing techniques, the cascade technique and the magnetic brush technique which are used with a two component system provide a number of advantages including the stability of the developing process, and are actually in use in most copying machines which are commercially available. However, they have certain disadvantages. Considering the magnetic brush technique by way of example, the developer used with this technique comprises a toner and a carrier, and any change in the proportion of mixture thereof results in an adverse influence upon the optical density of the resulting image.

Considering the developing technique which is used with a single component developer, the powder cloud technique and the impression technique involve a disadvantage that during the developing process, the toner may be deposited not only on an image area, but also on a non-image area of an electrostatic latent image which is formed on a latent image carrying member, resulting in a so-called background fogging which represents a degradation in image quality. The fogging is caused by the absence of a force which acts to detach any toner which may be held attracted to a non-image area by physical influences other than electrostatic attraction.

The jumping technique excels others in this respect. For example, as disclosed in Japanese Laid-Open Patent Application No. 43,037/1979, a multiple magnet assembly may be rotatably disposed inside a cylindrical developer carrier to grow and maintain a brush of developer around the periphery of the carrier, and a blade may be utilized to tip the brush to provide a control over the thickness of the developer layer so that such thickness may be maintained to a given value. The layer thickness is controlled such that a developer cannot be brought into contact with a non-image area of the latent image while the developer may be attracted to an image area of the latent image by the charge which is present in such area, thus achieving the developing process in a non-contact manner. However, such control over the layer thickness requires a high mechanical accuracy for various parts of the apparatus, and still is subject to the influences of humidity and temperature, resulting in the difficulty to provide a stable layer thickness.

Japanese Laid-Open Patent Application No. 119,142/1981 discloses a developing apparatus in which an alternating bias electric field is applied between a photosensitive drum, which represents a carrier for an electrostatic latent image, and a developer carrier, and in which the deposition of a developer onto a non-image area of the latent image is avoided by causing the bias field to alternate between a phase which allows the developer to be transferred onto the latent image and another phase which causes the transferred developer to be transferred in the opposite direction toward the developer carrier.

However, in this apparatus, the electrostatic latent image which is formed and maintained on the photosensitive drum is disturbed by the bias field though the degree of disturbance is reduced. While this does not cause any significant problem when producing a single copy per exposure, the latent image will be greatly degraded when producing multiple copies per exposure. The quality of the finally produced copy image will be degraded, producing the so-called background fogging in the non-image area.

SUMMARY OF THE INVENTION

It is an object of the invention to provide a developing apparatus for electrophotographic copying machines in which a piezoelectric element or a vibrator formed by such piezoelectric element is mounted on a developer carrier and is energized for vibratory displacement to cause the developer to fly in a manner to avoid the deposition of the developer onto a non-image area on a latent image carrying member.

It is another object of the invention to provide a developing apparatus for an electrophotographic copying machine which avoids any adverse influences upon an electrostatic latent image to cause a disturbance in the resulting image if applied in a multiple copy per exposure process to produce a plurality of copies.

In accordance with the invention, the piezoelectric element or the vibrator formed by such piezoelectric element is provided with electrodes, to which an alternating voltage is applied. By controlling the alternating voltage, the deposition of the developer onto a non-image area of the latent image is avoided, thus enabling a sharp image to be obtained which exhibits an improved contrast and which is free from the so-called background fogging. In this manner, when the developing apparatus is used in a multiple copy per exposure process to produce an increased number of copies, any disturbance in the latent image is prevented, thus assuring that a sharp image is obtained for the plurality of copies.

DETAILED DESCRIPTION OF PREFERRED EMBODIMENTS

Figure 1:
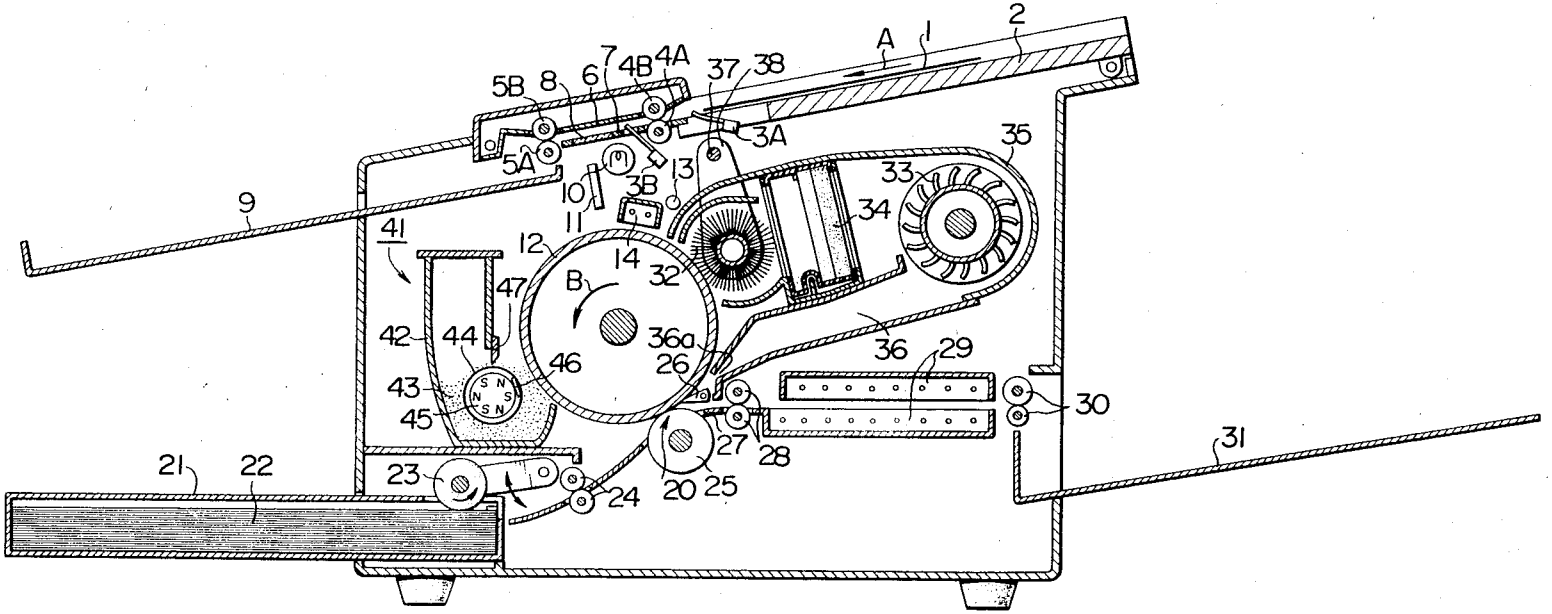
FIG. 1 is a longitudinal section of an electrophotographic copying machine in which a developing apparatus according to one embodiment of the invention is incorporated.

FIG. 1 shows an electrophotographic copying machine in which a developing apparatus of the invention may be incorporated. In the illustration, the copying machine is set up to define an original feed path which may be utilized to provide a copy from a single original in the form of a sheet. Specifically, when a sheet original 1 is placed on an inclined original guide table 2 and fed in the direction of an arrow A to be inserted into an inlet of an original feeder including pairs of conveying rollers 4A, 4B; 5A, 5B and guide plates 6, 7, the original 1 is held between the pair of vertically aligned conveying rollers 4A, 4B to be fed toward an exposure station 8 and is then passed between the guide plates 6, 7 and between the guide plate 6 and the exposure station 8. After passing through the exposure station 8, the original 1 is further fed forward by another pair of vertically aligned conveying rollers 5A, 5B to be delivered onto an original tray 9.

As the original 1 is fed by the original feeder, a pair of position detecting microswitches 3A, 3B, disposed on the opposite sides of the conveying rollers 4A, 4B operate to detect the position of the original 1 in order to control the timing of the operation of various parts of the copying machine. Specifically, as the original 1 passes through the exposure station 8, an illumination lamp 10 is energized to illuminate the surface of the original, and an optical system 11 operates to project the image of the original onto a photosensitive drum 12, which represents an electrostatic latent image carrying member. The drum 12 is adapted to rotate in a direction indicated by an arrow B. During its rotation, any charge on the drum is removed by a neutralizing lamp 13, and the drum is uniformly charged by a corona charger 14 and is then subject to an imagewise exposure to have an electrostatic latent image of the original 1 formed on its surface. A developing apparatus 41 according to the invention is used to develop the latent image with a toner to convert it into a visual image. The developing apparatus 41, the details of which will be described later, includes a vessel 42 which contains a quantity of a one component developer 43 or magnetic toner, a cylindrical developer carrier 44 having a multiple pole magnet assembly 45 and a piezoelectric element 46 disposed internally thereof, and a blade 47 attached to the vessel 42. By the action of the developing apparatus 41, the developer 43 is caused to fly toward and to be transferred onto the drum 12, thereby being deposited on only an image area of the latent image thereon to convert it into a visual image. The resulting toner image is conveyed to a toner image transfer station 20 as the drum 12 rotates.

The copying machine also includes a cassette 21 which contains a stack of transfer paper sheets 22, which are fed one by one by the action of a rocking and rotating feed roller 23 to be conveyed to the transfer station 20 by a pair of vertically associated feed rollers 24 at a given timing. In the transfer station 20, the transfer sheet 22 is conveyed into overlapping relationship with the toner image on the drum 12 through a nip between the drum 12 and the transfer member or a transfer roller 25, to which a bias voltage is applied to transfer the toner image. In the meantime, the transfer sheet is conveyed in close contact with the drum 12, and is subsequently separated therefrom by means of a separation claw 26 and an airstream to be described later. The transfer sheet having the toner image transferred thereto is then conveyed along a guide 27 to be conveyed by a pair of vertically aligned conveyor rollers 28 into a heat fixing unit 29 having a heater where the toner image is melted and fixed. Subsequently, the transfer sheet is delivered onto a copy tray 31 by a pair of vertically aligned delivery rollers 30.

A reduced amount of residual toner which remains on the drum 12 without being transferred is scraped off the drum by a rotating cleaning brush 32, and is collected by a filter 34 as a result of suction created by an airstream produced by a fan 33. The cleaning brush 32, the fan 33 and the filter 34 are enclosed within a casing 35 which is effective to produce an effective force to remove residual toner and to prevent the toner from being dispersed within the apparatus. An airstream displaced by the fan 33 is introduced into a duct 36 having an exhaust port 36*a* which is located adjacent to the transfer station 20, thus cooperating with the separation claw 26 to separate the transfer sheet effectively from the drum 12.

It will be seen that the electrophotographic copying machine described above is capable of producing a plurality of copies in succession, by repeating a developing step with toner and a transfer step, utilizing an electrostatic latent image repeatedly which is once formed on the drum 12. During such operation which produces multiple copies per exposure, the cleaning brush 32 is moved away from the drum 12 by rotating a holder 38 on which the brush is mounted. The holder 38 is rotatably mounted on a shaft 37. Also the neutralizing lamp 13 and the corona charger 14 are maintained deenergized.

Figure 2:
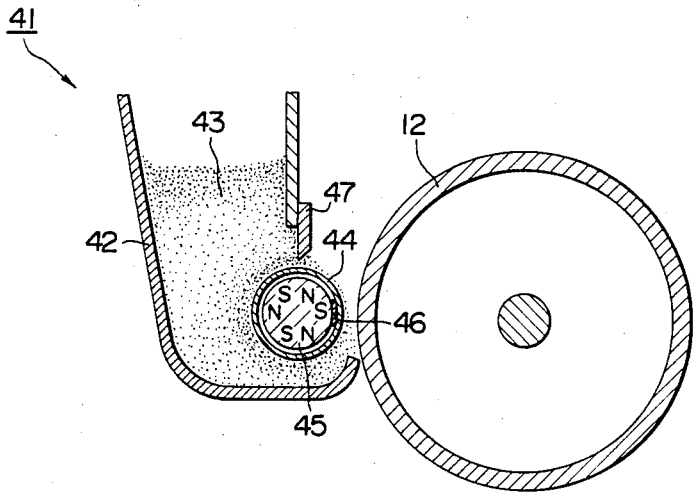
FIG. 2 is a fragmentary section of the developing apparatus shown in FIG. 1.
Figure 3:
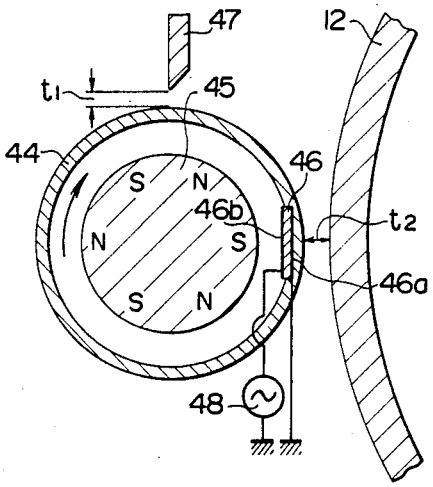
FIG. 3 is a fragmentary section, to an enlarged scale, of the apparatus shown in FIG. 2.

The developing apparatus 41 used in the manner mentioned above will now be more specifically described. Referring to FIG. 2, the vessel 42 which contains a quantity of developer is disposed close to the drum 12 in parallel relationship with the axis thereof. The developer carrier 44 comprises a metal sleeve which is fixedly mounted within the vessel 42 at a given spacing from the drum 12 so as to extend axially of the drum. The multiple pole magnet assembly 45 which is disposed inside the developer carrier 44 is formed by a roller and is rotatable. The assembly 45 operates to cause the developer 43 which comprises the magnetic toner to be held attracted upon the carrier 44 and to convey it around the carrier 44, thus acting as conveying means. At a location opposite to the drum 12, the internal wall surface of the carrier 44 carries the piezoelectric element 46 which is in the form of an elongate strip axially extending along the carrier 44. One electrode 46*a* (see FIG. 3) of the piezoelectric element 46 is in close engagement with the wall surface. The element 46 comprises lead titanate zirconate, barium titanate or other ceramic material. The electrode 46*a* of the element 46 is connected to the ground while the other electrode 46*b* is connected to a source of alternating voltage 48, the other end of which is connected to the ground. In this manner, the element 46 can be excited for vibratory displacement in the direction of its thickness in response to the application of an a.c. voltage across the electrodes 46*a*, 46*b*. The vibratory displacement of the piezoelectric element 46 is effective to cause an oscillation of the carrier 44 located in such region.

The blade 47 is disposed above the carrier 44 so as to control a layer thickness $t_1$ (see FIG. 3) of the developer 43 which is carried by the carrier 44. The layer thickness $t_1$ is less than the spacing $t_2$ (see FIG. 3) between the peripheral surface of the drum 12 and the developer carrier 44. Accordingly, when the magnet assembly 45 rotates clockwise, the magnetic force thereof causes the developer 43 to be conveyed clockwise around the peripheral surface of the carrier 44. In this manner, the developer 43 being conveyed is controlled to a given layer thickness $t_1$ by the blade 47 before it is conveyed toward the drum surface.

When the piezoelectric element 46 is energized from the source 48, it is excited for vibratory displacement in the direction of its thickness. The magnitude of such displacement x is given as follows:

$$x = d_{33} V$$

where $d_{33}$ represents the thickness longitudinal vibration coefficient and V the applied voltage.

The vibratory displacement of the element 46 is transmitted to the carrier 44, whereby the developer 43 carried by the peripheral surface of the latter flies toward the drum surface on which the latent image is formed. It will be appreciated from the above equation that the distance over which the developer flies depends on the magnitude of the displacement of the element 46 which in turn depends on the magnitude of the applied voltage. It will be appreciated that the developer 43 is subject to four kinds of forces, including the force created by the vibration of the element 46 to cause the developer to fly toward the drum 12, the magnetic force of the magnet assembly 45 which attracts the developer back to the carrier 44, the force of gravity and the electrostatic force produced by the charge present in an image area of the latent image on the drum 12 which tends to attract the developer onto the drum 12. By selecting a magnitude of the applied voltage to achieve a balance among these forces so that the developer cannot be flown to a non-image area of the latent image, but can be held attracted by the charge in an image area thereof, there is obtained a sharp image which is free from the so-called background fogging. The magnitude and the frequency of the applied voltage is selected in accordance with the diameter, the thickness, support means used and the elastic modulus of the carrier 44 as well as the specific gravity and the particle diameter of the developer. While no general statement can be made, the magnitude of the voltage is normally chosen in a range from several volts to several hundreds of volts, and it is desirable that the frequency be chosen to be in a range from 20 kHz to several MHz, for example, so that the resonant frequency, determined by factors including the construction of the carrier 44 and produced as a result of the acoustic output from the element 46, be located outside the audible range. However, a resonant frequency within the audible range may be chosen if the acoustic output at the resonant frequency has a small magnitude which is unobjectionable. Where a satisfactory flight of the developer 43 is assured, a resonant frequency as high as several MHz or higher may be chosen.

The developing apparatus 41 can be most effectively used in the production of multiple copies per exposure. It is to be noted that when a magnetic brush developing technique used in the prior art is applied to a copying process which produces a plurality of copies from a single exposure, the charge on an image area of the latent image may leak through the carrier present within the developer, a charge may be injected into a non-image area to disturb the image during the time a developing bias is applied to the developer vessel, or the potential of the latent image may shift as a result of the triboelectric effect which results from the tuft of the magnetic brush rubbing against the latent image carrying member, in the course of repeating the developing step a number of times. However, the developing apparatus 41 of this embodiment is basically constructed as a non-contact type as considered between the developer 43 and the drum 12, which prevents the above difficulties from occurring. As compared with the conventional jumping developing technique as applied to a copying process to produce multiple copies per exposure and wherein a disturbance in the electrostatic latent image may be caused as a result of an a.c. voltage applied between the latent image carrying member and the developer carrier to present difficulties in producing multiple copies, a.c. voltage is applied to the piezoelectric element 46 in the apparatus of this invention without any influence upon the drum 12, thus preventing any disturbance from occurring in the latent image after a number of developing steps and thus assuring that a sharp copy image be obtained.

The connection of the electrode 46*a* of the piezoelectric element 46 which is in close engagement with the developer carrier 44 to the ground provides a guard against any external induction, eliminating the likelihood that an alternating field may be developed between the drum surface and the electrode, thus further contributing to the prevention of any disturbance from occurring in the latent image.

Figure 4:
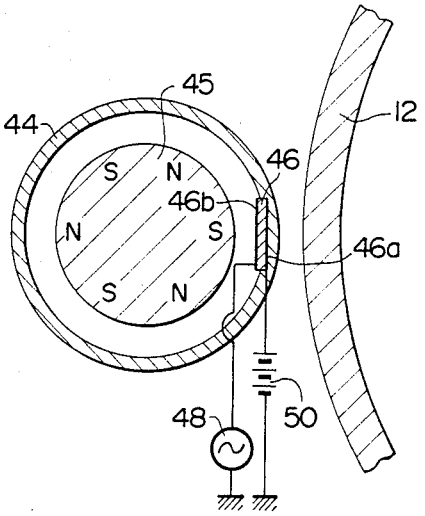
FIG. 4 is a fragmentary section, to an enlarged scale, of the apparatus shown in FIG. 2, illustrating its operation when a d.c. bias voltage is applied thereto.

As shown in FIG. 4, a source of d.c. voltage 50 may be connected between the electrode 46*a* of the piezoelectric element 46 which is closely engaged with the developer carrier 44 and the ground in order to apply a d.c. bias voltage as a developing bias, which permits a control over the optical density of the copy image.

Figure 5:
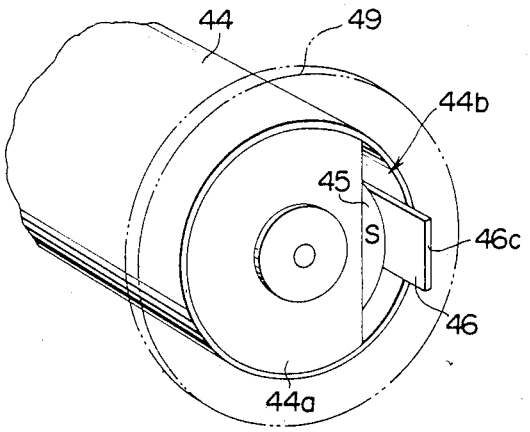
FIG. 5 is a perspective view, showing the construction of the end of the developer carrier shown in FIG. 2.

It will be noted that when the developer carrier 44 is supported in a manner such that the openings at its opposite axial ends are completely closed by end plates, the point of support represents a node of oscillation, thus reducing the amplitude of oscillations at the opposite ends as compared with the amplitude of oscillation at the center of the carrier 44, thus leading to a reduction in the optical density at or adjacent to the opposite ends of the copy image. To accommodate for this, as shown in FIG. 5, an end plate 44*a* of the carrier 44 may be formed with a crescent opening 44*b* in the region of the piezoelectric element 46 so that an end 46*c* of the latter extends therethrough. While only one end of the carrier is shown in FIG. 5, a corresponding arrangement is made on the opposite end thereof. In this manner, the opposite ends of the piezoelectric element 46 as well as the opposite ends of the carrier 44 where the element 46 is secured thereto are left free, permitting the developer carrier 44 to exhibit an amplitude of oscillation at the opposite ends which is comparable to the amplitude of oscillation at the center thereof throughout the area located opposite to the drum 12. In this manner, the optical density can be made uniform throughout the copy. Such effect can be enhanced by choosing an axial length of the carrier 44 which is slightly greater than the length of the drum 12. In FIG. 5, reference numeral 49 represents an annular block member formed of sponge material which prevents the developer from finding its way into the opening 44*b* to be deposited upon the multiple pole magnet assembly 45.

Figure 6:
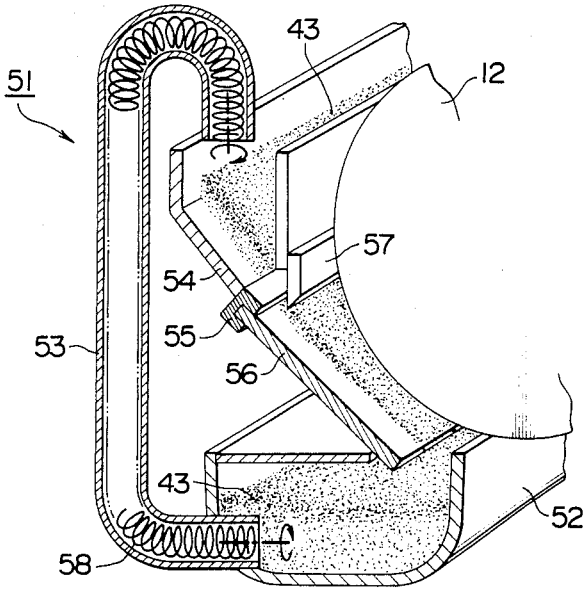
FIG. 6 is a fragmentary perspective view of a developing apparatus according to another embodiment of the invention.
Figure 7:
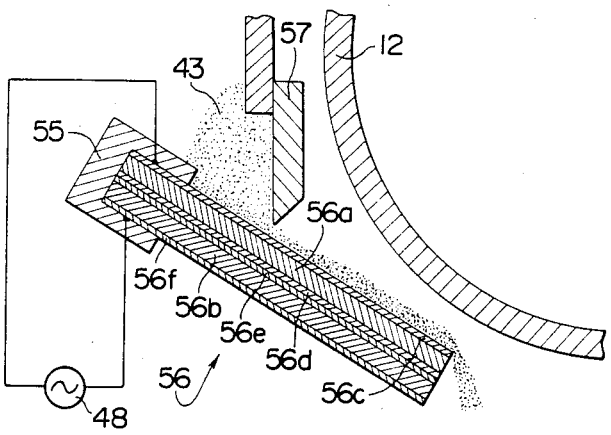
FIG. 7 is a fragmentary section, to an enlarged scale, of the apparatus shown in FIG. 6.

FIGS. 6 and 7 illustrate a developing apparatus according to another embodiment of the invention. In FIG. 6, the developing apparatus 51 includes a vessel 52 for containing a quantity of developer 43 therein. The vessel 52 is located below and offset to one side of a photosensitive drum 12 which serves as an electrostatic latent image carrying member. A pipe-shaped conveyor 53 has its lower opening connected to the side of the vessel 52 which is remote from the drum 12 and adjacent to the bottom thereof. A plate-shaped developer carrier 54 is disposed at an angle above the vessel 52 and adjacent to the drum 12, and its lower end carries a vibrator 56 having a so-called bimorph construction, by means of a holder 55. The conveyor 53 internally houses a helical rotating member 58 which serves as the means for conveying a developer. The top opening of the conveyor 53 is located in opposing relationship with the upper surface of the top of the carrier 54. It will be noted that a blade 57 is disposed above the vibrator 56 with a given spacing therebetween.

The construction of the vibrator 56 is shown in detail in FIG. 7. As shown, it comprises a pair of piezoelectric elements 56*a*, 56*b* in the form of sheets which are bonded together with their axes of polarization directed in opposite directions. These piezoelectric elements may comprise lead titanate zirconate, barium titanate or other ceramic material, and are adapted to produce a displacement in a direction orthogonal to the thickness. The upper element 56*a* carries a pair of electrodes 56*c*, 56*d* on its upper and lower surfaces while the lower element 56*b* carries a pair of electrodes 56*e*, 56*f* on its upper and lower surfaces. The electrodes 56*d*, 56*e* of elements 56*a*, 56*b* are tightly held together to define a single vibrator 56. A source of alternating voltage 48 is connected across the electrode 56*c* and the electrode 56*f*.

Figure 8:
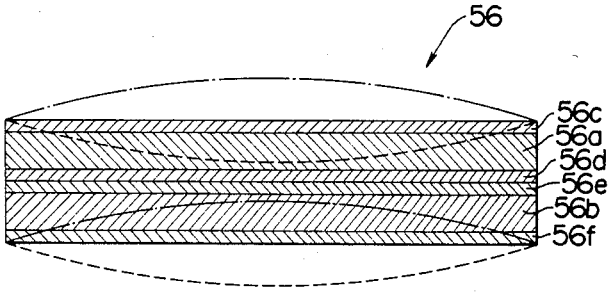
FIG. 8 is a schematic cross section illustrating the operation of a vibrator shown in FIGS. 6 and 7.

When the vibrator 56 is energized from the source 48, the element 56*a* expands in a direction perpendicular to the thickness while the element 56*b* shrinks in a direction perpendicular to the thickness for a first phase of the alternating voltage. Accordingly, the vibrator 56 as a whole deforms as indicated by the phantom lines as shown in FIG. 8. For a second phase of the alternating voltage, the element 56*a* shrinks while the element 56*b* expands, whereby the vibrator as a whole deforms in a manner indicated by broken lines in FIG. 8.

As the helical member 56 rotates within the conveyor 53, the developer 43 is conveyed from the vessel 52 to be delivered onto the carrier 54, and a layer thickness thereon is controlled by the blade 57 to be transferred onto the upper surface of the vibrator 56 subsequently. When the vibrator 56 oscillates in response to the first and the second phase of the alternating voltage, such oscillation is effective to cause the developer to fly toward the drum 12. The frequency and the magnitude of the voltage from the source 48 are selected so that the developer flies to a height which prevents it from being deposited on a non-image area of the latent image, but can be attracted to an image area thereof by the charge on an image area. Specifically, it will be understood that the developer 43 is subject to the drive which occurs as a result of the oscillation of the vibrator 56, the force of gravity, and the electrostatic attraction which is exerted by an image area of the latent image. Additionally, where the developer 43 comprises a magnetic toner, magnetic field generating means such as a magnet or a solenoid coil may be disposed on the opposite side of the drum 12 from the vibrator 56 to apply a magnetic attraction upon the developer 43. By choosing the frequency and the magnitude of the alternating voltage so as to achieve a desired balance between these forces, it is possible to allow the developer 43 to be selectively deposited only upon an image area of the latent image, thus allowing a sharp image which is free from background fogging to be produced. Usually, the magnitude of the alternating voltage is chosen in a range from several tens to several hundreds of volts and the frequency is chosen in a range from several tens of hertzes to several megahertzes. However, the specific values depend on the size, shape, thickness, manner of support and the elastic modulus of the vibrator 56. As discussed previously, the choice of the frequency may accompany the generation of an acoustic output as a result of the oscillation of the vibrator. Accordingly, where such acoustic effect is objectionable, it is desirable to achieve the resonance at a frequency outside the audible range such as above 20 kHz.

Figure 9:
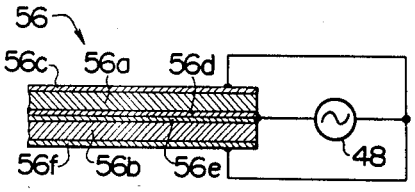
FIG. 9 is a schematic diagram of the vibrator, illustrating its connection with a power supply.

In the described embodiment, the source 48 is connected in series with the piezoelectric elements 56*a* and 56*b*. However, the source 48 may be connected in parallel with the piezoelectric elements 56*a* and 56*b*, as shown in FIG. 9, if these elements are bonded together with their axes of polarization directed in the same direction.

Figure 10:
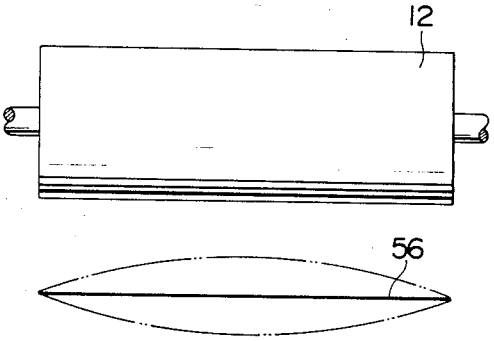
FIGS. 10 and 11 are schematic diagrams illustrating the relative position of the vibrator and the photosensitive drum in the apparatus shown in FIGS. 6 and 7.
Figure 11:
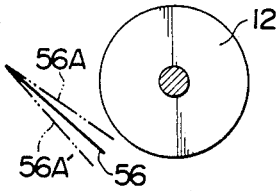

It will be appreciated that in an arrangement in which the opposite ends of the vibrator 56 corresponding to the opposite axial ends of the drum 12 are secured in some manner, the amplitude of oscillation will be reduced at the opposite ends of the vibrator, defining nodes of oscillation thereat as shown by phantom lines in FIG. 10. However, in the described embodiment, rather than supporting the vibrator 56 at its axial ends, it is secured, by means of the holder 55, to the developer carrier 54 along its upper edge which extends parallel to the axis of the drum 12. As a consequence, the vibrator 56 oscillates with a uniform amplitude, throughout, including the center as well as the opposite ends, between extreme positions 56A and 56A′, shown by phantom lines in FIG. 11, while its upper edge is secured to the holder 55, thus resulting in a uniform optical density over the entire copy image. As mentioned previously, the length of the vibrator 56 may be chosen so that its opposite ends extend beyond both axial ends of the drum 12.

The height to which the developer flies toward the drum 12 may be adjusted by the application of a d.c. bias voltage to the electrode 56*c* of the vibrator 56, in the same manner as mentioned previously. This enables a control over the optical density of the copy image. Alternatively, the electrode 56*c* of the vibrator 56 which is located in direct opposing relationship with the latent image carrying surface of the drum 12 may be connected to the ground to guard against external inductions or adverse influences of the alternating voltage.

It should be understood that the configuration of the developer carrier is not limited to a plate form, but it may be formed as a cylindrical carrier in the same manner as in the first mentioned embodiment, with similar effect.

The developing apparatus 51 can be applied to a multiple copy per exposure copying process to produce multiple copies having sharp images, since an increase in the number of copies does not result in any disturbance being produced in the latent image, in the same manner as the first mentioned developing apparatus 41.

What is claimed is:

1. A developing apparatus for an electrophotographic copying machine comprising:

conveyor means for conveying a developer from a developer vessel to a location adjacent to an electrostatic latent image carrying member;

a developer carrier disposed in opposing relationship with and at a given spacing from the latent image carrying member;

a vibrator mounted on the carrier and formed by a piezoelectric element having a pair of electrodes; and drive means for applying an alternating voltage across the electrodes of the vibrator to cause the latter to oscillate, thereby urging the developer on the carrier to fly toward the latent image carrying member.

2. A developing apparatus according to claim 1 in which the developer carrier is cylindrical in configuration and the conveyor means comprises a rotatable multiple pole magnet assembly disposed inside the cylindrical carrier so as to convey the developer from the vessel to a location adjacent to the latent image carrying member along the external surface of the carrier as the magent assembly rotates, one electrode of the vibrator being closely engaged with the internal wall of the carrier.

3. A developing apparatus according to claim 2 in which the opposite end faces of the cylindrical carrier are formed with openings at least in the region of the opposite ends of the vibrator.

4. A developing apparatus according to claim 1 in which the developer carrier comprises a plate member disposed at an angle to the vertical.

5. A developing apparatus according to claim 1 in which the opposite ends of the developer carrier extend beyond the opposite ends of a latent image region on the latent image carrying member.

6. A developing apparatus according to claim 1 in which the conveyor means comprises a pipe having its one end opening into the vessel and its other end opening at a location above the developer carrier, the pipe internally housing a helical rotating member which conveys developer from said one end to the other end as it rotates.

7. A developing apparatus according to claim 1 in which the vibrator comprises a single piezoelectric element forming part of the developer carrier.

8. A developing apparatus according to claim 1 in which the vibrator comprises a bimorph construction including a pair of piezoelectric elements bonded together and secured to part of the developer carrier which is located opposite to the latent image carrying member.

9. A developing apparatus according to claim 8 in which the piezoelectric element comprises lead titanate zirconate, barium titanate or other ceramic material.

10. A developing apparatus according to claim 1 in which one of the electrodes of the vibrator which is located opposite to the latent image carrying member is connected to ground potential.

11. A developing apparatus according to claim 1 in which a d.c. bias voltage is applied to one of the electrodes of the vibrator which is located opposite to the latent image carrying member.

12. A developing apparatus according to claim 8 in which the piezoelectric element comprises lead titanate zirconate, barium titanatte or other ceramic material.

13. A developing apparatus according to claim 1 further including a blade for limiting the height of the developer conveyed by the developer carrier to the latent image carrying member.

14. A developing apparatus according to claim 13 in which the separation distance between the blade and the developer carrier is less than the separation distance between the latent image carrying member and the developing carrier.

15. A developing apparatus according to claim 3 further including annular block members arranged at the ends of the cylindrical carrier for preventing developer from entering into the openings in the ends of said cylindrical carrier.

16. A developing apparatus according to claim 15 wherein said annular members are formed of a sponge material.

17. A developing apparatus according to claim 4 in which one end of said plate member is held stationary while the end of said plate member remote from the end being held stationary is free to vibrate so that the amount of movement of said plate increases with increasing distance from the end of said plate which is held stationary.

18. A developing apparatus according to claim 2 in which the space between the interior surface of the cylindrical carrier and the exterior surface of the magnet assembly is sufficient to permit vibration of the cylindrical carrier to be unimpeded.

19. A developing apparatus according to claim 1 in which the AC voltage is varied over a range from 20 kHz to several MHz.

20. A developing apparatus according to claim 1 wherein the amplitude of the AC voltage applied to the vibrator lies in the range from several volts to several hundreds of volts.

* * * * *